United States Patent [19]

Von Semel et al.

[11] 3,941,667

[45] Mar. 2, 1976

[54] METHOD FOR THE REPROCESSING OF CELL LIQUOR FROM DIAPHRAGM CELL ELECTROLYSIS PLANTS

[75] Inventors: Georg Von Semel, Dortmund; Eduard Schibilla, Dortmund-Solde; Wolfgang Strewe, Dortmund, all of Germany

[73] Assignee: Friedrich Uhde GmbH, Dortmund, Germany

[22] Filed: Mar. 21, 1975

[21] Appl. No.: 560,707

[52] U.S. Cl. ..... 204/98; 204/128; 423/195; 423/199; 423/551

[51] Int. Cl.[2] .... C25B 1/16; C25B 1/26; C01D 5/04

[58] Field of Search ..... 204/98, 128, 129; 423/195, 423/199, 551

[56] References Cited

UNITED STATES PATENTS

| | | | |
|---|---|---|---|
| 3,533,748 | 10/1970 | Finfer et al. | 423/551 |
| 3,873,672 | 3/1975 | Nishiba et al. | 423/551 |

*Primary Examiner*—R. L. Andrews

*Attorney, Agent, or Firm*—Malcolm W. Fraser

[57] ABSTRACT

A method for the reprocessing of cell liquor from diaphragm cell electrolysis plants that operate on potassium chloride brine. The cell liquor is contacted with an $SO_2$-bearing gas, and the effluent solution is oxidized with an oxygen-bearing gas, then a definite quantity of KCl is added to said oxidized solution, and this solution is subjected to a filtration and precipitation step, and finally it is then recycled as make-up brine to the electrolysis cell plant.

3 Claims, 1 Drawing Figure

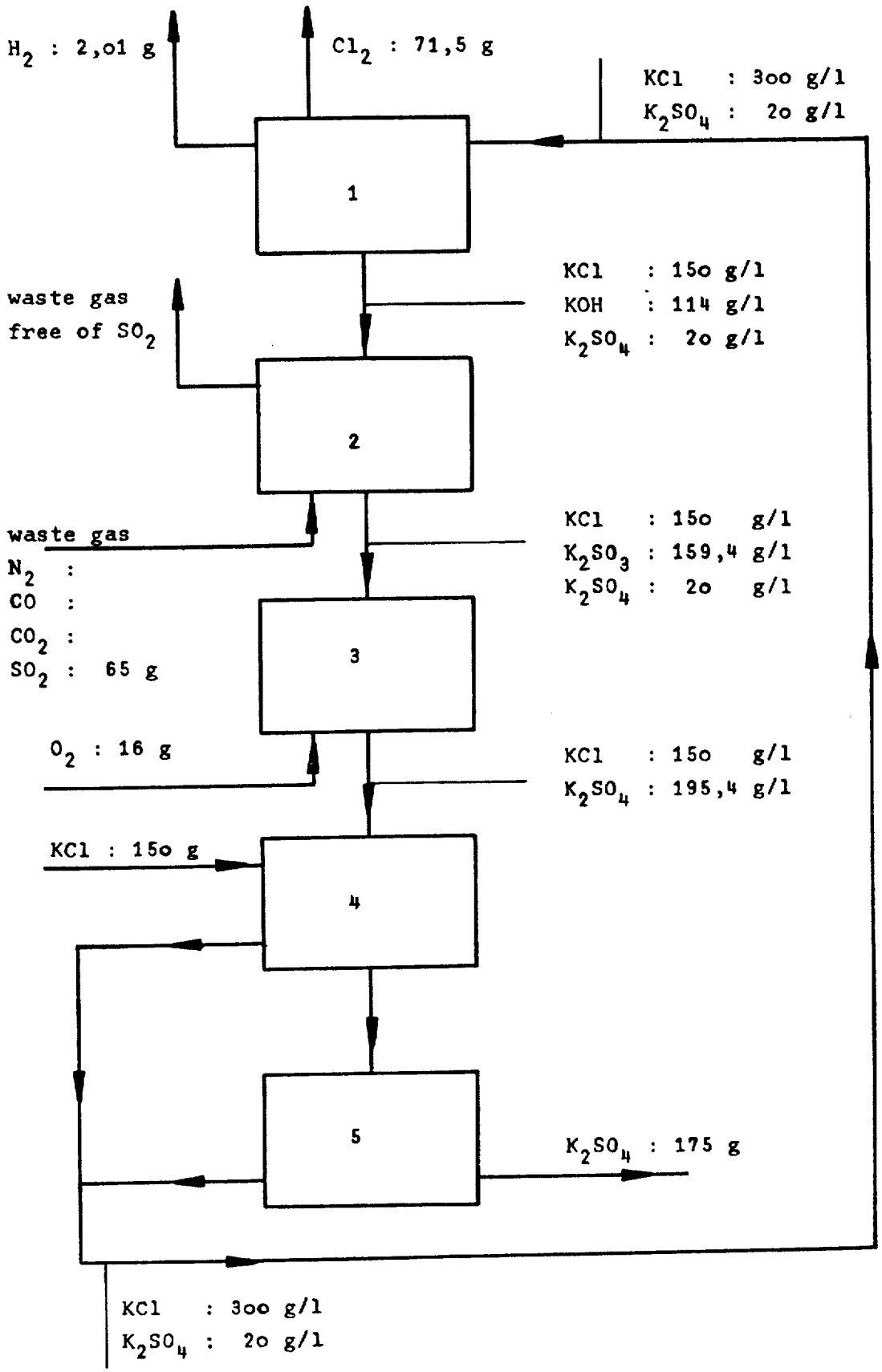
$H_2$ : 2,o1 g
$Cl_2$ : 71,5 g
KCl : 3oo g/l
$K_2SO_4$ : 2o g/l
1
KCl : 15o g/l
KOH : 114 g/l
$K_2SO_4$ : 2o g/l
waste gas
free of $SO_2$
2
waste gas
$N_2$ :
CO :
$CO_2$ :
$SO_2$ : 65 g
KCl : 15o g/l
$K_2SO_3$ : 159,4 g/l
$K_2SO_4$ : 2o g/l
3
$O_2$ : 16 g
KCl : 15o g/l
$K_2SO_4$ : 195,4 g/l
KCl : 15o g
4
5
$K_2SO_4$ : 175 g
KCl : 3oo g/l
$K_2SO_4$ : 2o g/l

METHOD FOR THE REPROCESSING OF CELL LIQUOR FROM DIAPHRAGM CELL ELECTROLYSIS PLANTS

BACKGROUND OF THE INVENTION

It is known that a diaphragm cell electrolysis plant is fed with a potassium chloride brine of a certain definite composition. By the application of electricity, the brine contained in the electrolysis cell is subjected to electrolytic decomposition into chlorine and hydrogen with the simultaneous formation of potassium solution, i.e. KOH. An adequate quantity of potassium solution, hereinafter referred to as cell liquor, must continuously be withdrawn from the electrolysis cell, said quantity being related to the production of $Cl_2$ and $H_2$. There is generally no direct use for this cell liquor because its KOH concentration is very low while the percentage of residual KCl is appreciable. The cell liquor commonly contains, for example, 100–150 g KOH/l and 180–200 g KCl/l. To convert this cell liquor into a marketable product, it is necessary to raise its concentration to approximately 700 g KOH/l by evaporation which causes the major portion of KCl to be precipitated from the liquor in crystalline form. Evaporation of the liquor and separation of crystalline KCl requires inherently uneconomical multistage facilities of highly corrosion-resistant materials of construction, such as nickel for example. In addition, a quantity of 2 to 3 tons of steam per ton of KOH is needed for cell liquor evaporation, said quantity being dependent on the number of evaporation stages.

The high capital costs of the cell liquor evaporation facilities and the high process energy requirements are bound to burden the final product heavily from the standpoint of sales price.

SUMMARY OF THE INVENTION

The object of the invention is to provide a method for combining a diaphragm cell KCl electrolysis plant with other processes in such a way that costly facilities for cell liquor evaporation and crystallization may be omitted.

According to the invention, the problem is solved by contacting the cell liquor from the diaphragm cell electrolysis plant with an $SO_2$-bearing gas, oxidizing the effluent solution with an oxygen-bearing gas, adding a defined quantity of KCl to said oxidized solution, subjecting this solution to a filtration and precipitation step and recycling it as make-up brine to the electrolysis cell plant.

The invention offers the particular advantage that it eliminates the need for the conventional costly cell liquor reprocessing facilities, such as liquor evaporation with the aid of superheated steam and separation of the crystals of filtration or other means. In addition, the method according to the invention is not accompanied by the continuous formation of an intermediate product, for example KOH, which would involve certain storage problems.

It is another particular advantage that the $K_2SO_4$ obtained by precipitation is in good demand and that the $K_2SO_4$ can be stored at any place if and when required.

BRIEF DESCRIPTION OF DRAWING

The FIGURE is a diagram of the several steps of the method in accordance with the invention showing the concentration levels and quantities involved.

DESCRIPTION OF THE PREFERRED EMBODIMENT

The example shown on the drawing starts from a diaphragm cell electrolysis plant receiving a brine feed stream as electrolyte which has a concentration of 300 g KCl/l and 20 g $K_2SO_4$/l.

Assuming that the electrolysis process be adjusted to yield an effluent electrolyte, now designated as cell liquor, that contains 150 g KCl/l, 114 g KOH/l, and 20 g $K_2SO_4$/l, said effluent solution can be employed for retaining $SO_2$ at a rate of 65 g $SO_2$/l solution. The exhaust gas discharged from the waste gas cleaning unit 2 has a residual $SO_2$ content of some ppm, said content depending on the design of the scrubbing tower.

Absorption of the $SO_2$ is expediently performed at a pressure of approximately 3 to 25 bar and a temperature ranging from 50° to 100°C. The effluent solution from the gas scrubbing tower is oxidized with air or any similar oxygen-bearing gas in a downstream oxidation stage 3. It is imperative that all $K_2SO_3$ be oxidized to $K_2SO_4$. It has been evidenced that the inventive idea incorporates a significant and advantageous feature in that the $K_2SO_4$ contained in the circulating solution at a rate of 20 g/l, for example, has a favorable effect on the oxidation rate in oxidation tower 3. If the effluent mixture from the oxidation tower is sent to dissolver 4 for being stirred and simultaneously admixed with KCl at a rate required to obtain the composition of make-up brine for the diaphragm cell electrolysis plant, the major portion of $K_2SO_4$ precipitates in a crystalline and relatively pure form, said precipitation being conditional upon relative solubility. The $K_2SO_4$ crystals are separated and dried in a downstream stage 5 and can subsequently be sent to storage. The mother liquor withdrawn from KCl dissolver and $K_2SO_4$ separator, i.e. stages 4 and 5, is a ready-to-use make-up brine for feeding the diaphragm cell electrolysis plant and does not require any further reprocessing or adjustment of concentration.

After recycling the brine through the diaphragm electrolysis cell for the electrolytic production of chlorine and hydrogen, the reprocessing cycle starts again with the cell liquor being sent to the top of scrubbing tower 2. It is another characteristic feature of the invention that the waste gas scrubbing unit for the removal of $SO_2$ does not need any regeneration facilities for the scrubbing solution. The inventive idea to combine a diaphragm cell electrolysis plant for the processing of potassium chloride brine and a gas scrubbing unit for the removal of $SO_2$ eliminates the need for conventional regeneration facilities.

By adding KCl in the fourth stage, the solubility of the $K_2SO_4$ is reduced to a point where not more than approximately 20 g $K_2SO_4$/l remains in the circulating solution. This potassium sulphate concentration will not cause operating troubles in a diaphragm cell electrolysis plant equipped with dimensionally stable anodes (metal anodes). Even a rise of the sulphate concentration in the electrolyte will not entail an enrichment of the gaseous chlorine with $O_2$, $CO_2$ and CO because metal anodes with an activating coating are known to have a higher $O_2$ overvoltage than graphite anodes.

The performance of the various process steps and the design of the different items of equipment may be considered as being common technological practice.

What we claim is:

1. Method for reprocessing cell liquor from a diaphragm cell electrolysis plant having potassium chloride brine cycle comprising 1. removing an effluent cell liquor solution from the diaphragm cell electrolysis plant,
2. contacting the solution with an $SO_2$-bearing gas,
3. oxidizing the solution with an oxygen-bearing gas, 4. adding a predetermined quantity of KCl to the oxidized solution,
5. subjecting the solution to a filtration and precipitation step, and
6. recycling the solution as a make-up brine to the diaphragm cell of the electrolysis plant.

2. The method of claim 1, in which the make-up brine fed to the diaphragm cell has a KCl content of 250 to 300 grams/liter.

3. The method of claim 1 wherein the solution produced is a $K_2SO_3$ solution, comprising oxidizing the $K_2SO_3$ solution to $K_2SO_4$ with an oxygen-bearing gas at a temperature of 50° to 100°C., and under a pressure of 3 to 24 atmospheres.

* * * * *